US005333531A

United States Patent [19]

Field

[11] Patent Number: 5,333,531

[45] Date of Patent: Aug. 2, 1994

[54] REVOLVER FIREARM WITH GAS SEALING

[76] Inventor: Roger Field, Eisenbahn Str. 5A, 7570 Baden Baden, Fed. Rep. of Germany

[21] Appl. No.: 22,745

[22] Filed: Feb. 19, 1993

Related U.S. Application Data

[63] Continuation of Ser. No. 836,530, Feb. 18, 1992, abandoned.

[51] Int. Cl.[5] ..... F41A 3/76

[52] U.S. Cl. ..... 89/26; 42/59

[58] Field of Search ..... 42/75.02, 59, 65, 1.07; 89/14.05, 26

[56] References Cited

U.S. PATENT DOCUMENTS

| | | | |
|---|---|---|---|
| 325,878 | 9/1885 | Tyler | 42/59 |
| 338,760 | 3/1886 | Merritt | 89/26 |
| 946,351 | 1/1910 | Haeghen | 89/26 |
| 1,965,637 | 7/1934 | Frederich et al. | 42/59 |
| 2,981,023 | 4/1961 | Sergay | 42/59 |
| 3,280,495 | 10/1966 | Lewis | 42/59 |
| 3,842,527 | 10/1974 | Low | 42/75.02 |
| 4,455,777 | 6/1984 | Callies | 42/59 |
| 5,048,216 | 9/1991 | Casull | 42/59 |

FOREIGN PATENT DOCUMENTS

| | | | |
|---|---|---|---|
| 2465182 | 3/1981 | France | 42/59 |
| 527020 | 10/1940 | United Kingdom | 42/59 |

*Primary Examiner*—Stephen M. Johnson

[57] ABSTRACT

In a revolver, a sleeve is attached to the outside rear section of the barrel and can be turned to adjust abutment with a forward portion of the cylinder of the revolver.

4 Claims, 1 Drawing Sheet

REVOLVER FIREARM WITH GAS SEALING

This application is a continuation of Ser. No. 07/836,530, filed on Feb. 18, 1992 and now abandoned.

BACKGROUND OF THE INVENTION

This invention relates to a simple method of minimizing the gap between the barrel rear, usually a forcing cone, and the front face of the cylinder of a revolver firearm, which is independent of manufacturing tolerances. It is known that revolvers and other firearms with a cylinder for firing ammunition have a gap between the forcing cone and the cylinder, which cannot be avoided because of manufacturing tolerances, and therefore cannot be held to a minimum in mass produced firearms. The maximum allowable gap size is about 0.3 mm although a maximum of about 0.22 mm is preferred. There is a pressure drop at this gap when a cartridge is fired and lead particles, which can be hazardous, frequently emanate under great pressure. The bottom of the top strap may also suffer flame cutting. Manuhrin, which manufactures expensive revolvers, holds the gap to a minimum by expensive hand fittings on their target revolvers.

Nagant attempted to solve this problem by camming the cylinder forward during firing, so that no gap existed between the cylinder face and the cone. This system was relatively complicated.

SUMMARY OF THE INVENTION

It is the purpose of this invention to offer a simple system of sealing the gap between the cylinder and the cone as much as possible, leaving only a very minimal gap to allow the cylinder to rotate.

A sleeve is positioned around the rear of the barrel, or cone, between the frame and the cylinder. This can be attached in several ways to reduce the gap to a minimum.

It is necessary to position the sleeve as far back as the cylinder. It should then be held securely. The sleeve may be screwed back around a thread on the outside of the cone, and may be secured by a screw which may be attached through the topstrap. The sleeve may be designed to be easily turned with outside knurling. A spring may also be placed around the cone between the frame and the sleeve. The sleeve may also be clamped tightly around the cone, or attached some other way.

It is a fact that magnum revolvers can suffer frame stretch. This causes endshake of the cylinder and increases the cylinder-to-cone gap. In this case, the sleeve can be screwed further a back.

A preferred embodiment of the invention is described in the following description and drawings.

A BRIEF DESCRIPTION OF THE DRAWINGS

A DESCRIPTION OF THE PREFERRED EMBODIMENT

Figure 1:
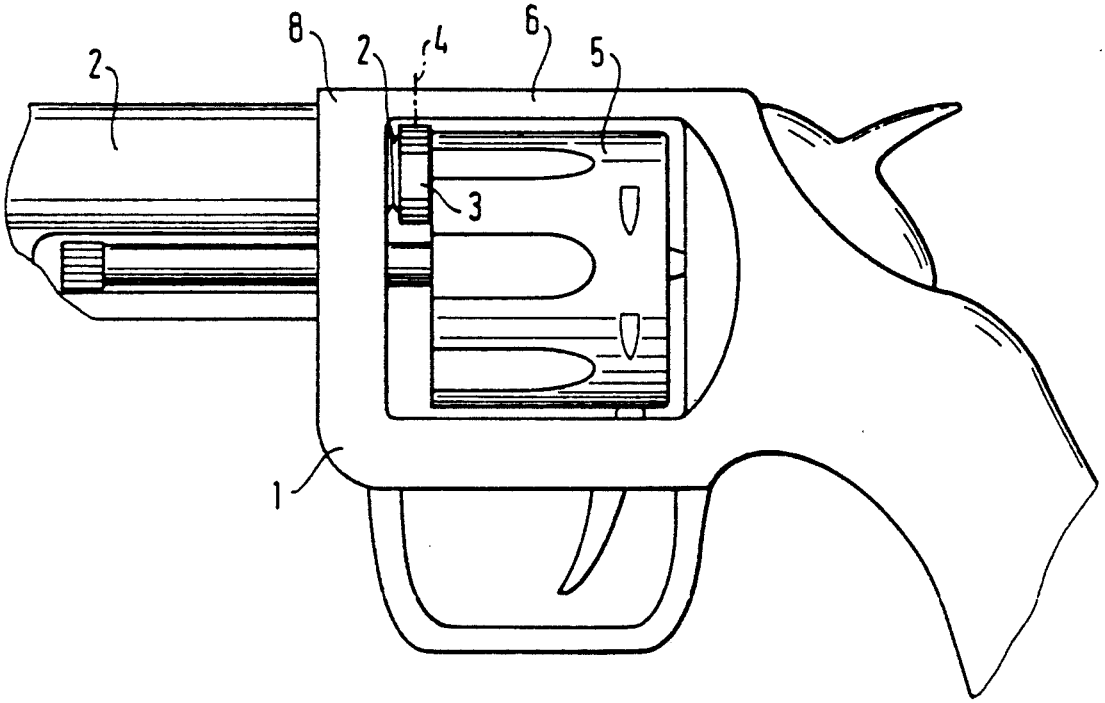
FIG. 1 shows a side view of a revolver with a sleeve attached around the rear of barrel.
Figure 2:
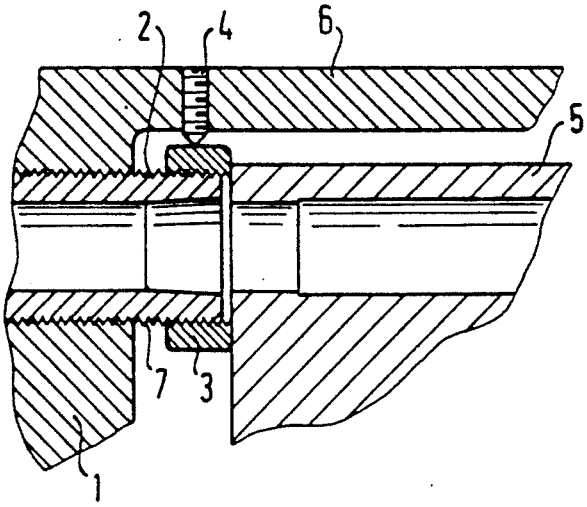
FIG. 2 shows a sectional detail of the rear of barrel, the sleeve, the topstrap and the cylinder.

A sleeve (3) is attached concentrically to the outside of the rear of barrel (2) as shown in FIGS. 1 and 2, which has an outside thread (7), on a revolver (1).

Sleeve (3) has been turned to rear until it abutted cylinder (5), although cylinder can still turn freely. A screw (4), facing downward, which is attached to top (6), of frame 8 secures sleeve (3).

I claim:

1. A revolver firearm having a barrel with a longitudinal axis, a cylinder for storing and firing cartridges, and a frame for supporting said barrel and said cylinder, said barrel having an outside circumference, said outside circumference having a rear section, said rear section extending behind a rear face of a forward portion of said frame, said cylinder having a given length with a front and a rear face, said cylinder being positioned on an axle, said axle being positioned parallel to said longitudinal axis of said barrel, with a gap between said rear section of said barrel and said front face of said cylinder, the improvement comprising a sleeve (3) positioned around said rear section of said outside circumference of said barrel (2), said sleeve (3) being brought toward said front face of said cylinder (5) along said longitudinal axis of said barrel (2) to reduce the effects of said gap (10) to a minimum against gas pressure when firing a cartridge of said firing cartridges.

2. A revolver firearm as in claim 1, said rear section of said outside circumference of said barrel (2) having an outside thread, said sleeve (3) having a matching inside thread for adjusting the position of said sleeve (3) along (said horizontal axis of said barrel (2) said longitudinal axis of said barrel (2).

3. A revolver firearm as in claim 1 or 2 wherein said sleeve (3) is secured from movement by at least one screw (4).

4. A revolver firearm as in claim 1 or 2 wherein said sleeve (3) is secured from movement by at least one screw (4), said at least one screw (4) being attached to a part of said frame (3).

* * * * *